United States Patent [19]

Pope et al.

[11] 4,377,507

[45] Mar. 22, 1983

[54] CONTAINING NUCLEAR WASTE VIA CHEMICAL POLYMERIZATION

[75] Inventors: James M. Pope, Monroeville; Susan Wood, Pittsburgh; Don E. Harrison, Murrysville, all of Pa.

[73] Assignee: Westinghouse Electric Corp., Pittsburgh, Pa.

[21] Appl. No.: 162,967

[22] Filed: Jun. 25, 1980

[51] Int. Cl.[3] ..... G21F 9/16

[52] U.S. Cl. ..... 252/629; 501/12

[58] Field of Search ..... 252/629; 501/12

[56] References Cited

U.S. PATENT DOCUMENTS 3,959,172 5/1976 Brownell et al. ..... 252/301.1 W 4,224,177 9/1980 Macedo ..... 252/301.1 W 4,266,978 5/1981 Prochazka ..... 501/12

*Primary Examiner*—Deborah L. Kyle

*Attorney, Agent, or Firm*—R. D. Fuerle

[57] ABSTRACT

Disclosed is a method of immobilizing nuclear waste in glass. A composition is prepared of 60 to 100% of a hydrolyzed glass-forming silicon compound and up to about 40% of a glass-forming aluminum compound. About 1 to about 50% liquid nuclear waste and up to about 10% solid nuclear waste is mixed into the composition. The composition is heated at about 200° to about 500° C. to drive off water and organics, with the resulting vitreous product totally containing the nuclear waste. Finally, this product can be sintered at about 800° to about 900° C. to reduce porosity, or warm pressed into block form.

9 Claims, No Drawings

CONTAINING NUCLEAR WASTE VIA CHEMICAL POLYMERIZATION

BACKGROUND OF THE INVENTION

Reprocessing of either spent nuclear fuel or weapons material results in liquid waste which must be reduced in volume and consolidated to permit safe disposal. The current practice is to dehydrate the liquid waste by heating, then to consolidate the residue by either calcination or vitrification at high temperatures. In the past, defense waste was neutralized in order to precipitate metallic hydroxides. This product can be converted into a vitreous waste form using conventional glass forming technology.

The ultimate suitability of vitreous waste forms is suggested by the durability of rhyolytic obsidian and tektite natural glasses during millions of years in a variety of geologic environments. Unfortunately, these chemically durable, high-silica glasses pose problems as a practical solid-waste form, when made using conventional continuous vitrification processes. Because of the high fluxing temperatures (~1350° C.) required, additional off-gassing scrubbing capacity or other absorbent procedures are needed to deal with the volatilization losses of radionuclides such as iodine, cesium, and ruthenium. The high fluxing temperature also shorten furnace life, and can create problems with the materials into which the molten glass is cast, such as the sensitization of stainless steel to stress corrosion cracking. As a consequence of these limitations, most nuclear waste glass formulations have substantially lower silica content than either natural obsidians, nepheline syenite, or commercial "Pyrex" glasses. Less silica or alumina and more fluxing agent (e.g., $Na_2O$, $K_2O$ or $B_2O_3$) lowers the glass working temperature (to 1000°-1200° C. for most waste glasses) and raises the waste loading capacity. However, this also results in lower chemical durability in most aqueous environments and, particularly for borosilicate compositions, in less resistance to devitrification.

SUMMARY OF THE INVENTION

We have discovered that the formation of aluminosilicate glasses by chemical polymerization can effectively contain nuclear waste. The process of this invention avoids the volatilization losses that occur with conventional glass forming processes because the temperatures used in the process of this invention are relatively low. The invention immobilizes the nuclear waste in a highly leach resistant glass which could not be formed by prior processes except at very high temperatures.

PRIOR ART

U.S. Pat. application Ser. No. 65,706 filed Aug. 10, 1979, now abandoned, continuation of Ser. No. 200,164 filed Oct. 24, 1980, now U.S. Pat. No. 4,361,598, discloses the hydrolyzation of alkoxides and their subsequent polymerization to form glass structures.

CROSS-REFERENCE TO RELATED APPLICATIONS

This application is related to application Ser. No. 162,966 filed concurrently herewith by J. M. Pope et al. entitled "Containment of Nuclear Waste."

DESCRIPTION OF THE INVENTION

The composition of this invention which is used to contain the nuclear waste is prepared from a silicon compound and an aluminum compound. The silicon compound has the general formula:

$$SiR_m(OR')_nX_p \text{ or } Si(OSiR)_4$$

where each R is independently selected from alkyl to $C_{10}$ or alkenyl to $C_{10}$, each R' is independently selected from R and aryl, each X is independently selected from chlorine and bromine, m is 0 to 3, n is 0 to 4, p is 0 to 1, and m+n+p is 4. The $SiR_m(OR')_nX_p$ compounds are preferred as those compounds are more available, easier to handle and more compatible. The R' group is preferably alkyl to $C_4$ with n=4 because alkoxides are the most suitable starting compounds.

Appropriate compounds which fall within the scope of the general formula include

| | |
|---|---|
| trimethylethoxysilane, | $(CH_3)_3Si(OC_2H_5)$ |
| ethyltriethoxysilane | $C_2H_5Si(OC_2H_5)_3$ |
| tetrapropoxysilane | $Si(OC_3H_7)_4$ |
| tetraethylorthosilicate | $Si(OC_2H_5)_4$ |
| tetratriethylsiloxysilane | $Si[OSi(CH_3)_2C_2H_5]_4$ |
| triethylchlorosilane | $(C_2H_5)_3SiCl$ |
| vinyltriphenoxysilane | $CH_2$: $CHSi(OC_6H_5)_3$. |

The preferred silicon compound is tetraethylorthosilicate because it is relatively inexpensive, readily available, stable, and easy to handle. The above compounds are partially hydrolyzed with water in alcohol. It is preferable to partially hydrolyze the silicon compound prior to mixing it with the other components because its rate of hydrolysis is slower and precipitation may occur if hydrolysis is done after mixing. It is preferable to use the same alcohol that is formed during subsequent polymerization so that two alcohols need not be separated. A suitable molar ratio of the silicon compound to the alcohol is about 0.2 to about 2. A suitable molar ratio of the silicon compound to the water used in hydrolysis is about 0.1 to about 5. In addition, it is sometimes helpful to add up to about 6 drops of concentrated nitric acid per mole of water to aid in hydrolyzation. After the water is added to the silicon compound the compound is permitted to sit for several hours to permit hydrolyzation to occur.

The aluminum compounds which are suitable for use in this invention have the general formula:

$$AlR_q'(OR)_rX_s \text{ or } Mg(Al(OR)_4)_2 \text{ or } Al(OH)_3$$

where each R' is independently selected from R and aryl, q is 0 to 3, r is 0 to 3, s is 0 to 1, and q+r+s=3. The $AlR_q'(OR)_rX_s$ compounds, where r is 3 and R is alkyl to $C_4$, are preferred as they are the most stable and available and are easiest to handle. The R group in the aluminum compound need not be the same R group that is in the silicon compound.

Suitable compounds which fall within the scope of the general formula include

| | |
|---|---|
| trimethylaluminum | $Al(CH_3)_3$ |
| triethylaluminum | $Al(C_2H_5)_3$ |
| triethoxyaluminum | $Al(OC_2H_5)_3$ |
| aluminum isoproponate | $Al(OC_3H_7)_3$ |
| aluminum secondary butoxide | $Al(OC_4H_9)_3$ |

-continued

| | |
|---|---|
| triphenyl aluminum | $Al(C_6H_5)_3$ |
| aluminum magnesium ethoxide | $Mg[Al(OC_2H_5)_4]_2$ |
| diethylaluminum chloride | $(C_2H_5)_2AlCl$ |

The preferred aluminum compounds is aluminum secondary butoxide because it is stable, available, and does not require special handling. The aluminum compound (other than the hydroxide) is preferably hydrolyzed before it is added to the silicon compound because the mixture will then act compatibly as a single compound and inhomogeneities will be avoided. The molar ratio of the aluminum compound to the water used to hydrolyze it can range from about 0.0007 to about 0.03. The water should be hot (i.e., between 70° and 100° C., and preferably between 80° and 90° C.) to facilitate proper hydrolyzation. In addition, it may be desirable to use about 0.03 to about 0.1 moles of 1 molar nitric acid per mole of AlO(OH), which is the desired product of the hydrolyzation, to aid in its peptization. After the addition of the water, the compound is permitted to sit for at least several hours at about 80° to 90° C. to permit proper hydrolyzation and peptization to occur.

After the silicon compound and the aluminum compound have been separately hydrolyzed they are mixed to prepare the composition. The composition may include about 60 to about 100% by weight of the silicon compound, calculated as $SiO_2$ and based on the total weight of $SiO_2+Al_2O_3$, and up to about 40% by weight of the aluminum compound, calculated as $Al_2O_3$, based on the total weight of $SiO_2+Al_2O_3$. Preferably, the composition comprises about 70% to about 90% by weight of the silicon compound, calculated as $SiO_2$, and about 10% to about 30% of the aluminum compound, calculated as $Al_2O_3$, because more than about 30% of the aluminum compound may make the composition more difficult to warm press. At less than about 10% of the aluminum compound the durability of the glass may suffer.

The composition can immobilize both solid nuclear waste and an aqueous solution of nuclear waste. The dissolved nuclear waste is usually nitrate solutions of various metals including iron, uranium, nickel, magnesium, calcium, zirconium, plutonium, chromium, cobalt, strontium, ruthenium, copper, cesium, sodium, cerium, americium, niobium, thorium, and curium. Depending on the species present, it may be preferable to adjust the pH of the nuclear waste solution with a hydroxide so that it approximates the pH of the glass composition. The dissolved nuclear waste can contain from about 5% dissolved solids to saturated, and a typical solution of nuclear waste may have about 10% to about 30% solids in solution. For example, a typical nuclear waste is up to about 15% by weight nitrate and up to about 85% by weight water. Up to about 50% based on the total weight of the waste plus the glass composition can be nuclear waste in liquid form.

Solid nuclear waste can also be added to the glass composition. Solid nuclear waste generally consists of the hydrated oxides and hydroxides, and possibly sulfates, phosphates, nitrites, or other salts of the metals listed above. Up to about 10%, based on the total weight of the nuclear waste and the composition, may consist of solid nuclear waste.

The nuclear waste material is added to the glass composition with stirring and the mixture is dried. The drying, which polymerizes the silicon and aluminum oxides, may begin at room temperature and extend to about 150° C. at a rate of temperature increase of about 1° C. to about 10° C. per minute. Between about 150° C. and about 200° C. the mixture may be heated more rapidly (e.g., at a rate of temperature increase of about 10° C. to about 50° C. per minute) in order to more effectively drive off the carbon. Finally, between about 200° C. and about 500° C. the mixture is again heated at the slower rate of temperature increase of about 1° C. to about 10° C. per minute in order to remove the remaining water of hydration and any ogranics which may be present.

The resultant 500° C. product is vitreous granules, about 1–10 mm in diameter, which effectively contain the nuclear waste. This containment is generally by complete dissolution in glass, although encapsulation in the sense that certain few insoluble species are totally surrounded by the glass may also occur. The granules typically have a high surface area, although their durability and stability do not appear to be adversely affected. Nevertheless, it may be desirable to further process the granules. For example, sintering at about 800° C. to about 900° C. for up to about 10 hours will reduce the surface area of the granules from about 500 $m^2/g$ to less than approximately 10 $m^2/g$.

To prepare a solid block of contained and immobilized nuclear waste the waste-glass granules are warm pressed at about 350° C. to about 600° C. using about 30,000 to 150,000 psi, depending on the temperature. The higher the temperature, the lower is the pressure that will be needed, and the lower the temperature is, the higher the pressure will need to be in order to produce a solid block. After about one half hour of warm pressing a solid block of the immobilized waste is produced. The following example further illustrates this invention.

EXAMPLE

The following compounds were added in sequence at room temperature.

90 grams of pure ethyl alcohol 9 grams of deionized water (1 mole $H_2O$/mole tetraethylorthosilicate)

1 drop concentrated (7.45 M) $HNO_3$ 104 grams tetraethylorthosilicate

The composition was stirred for 15 minutes, covered tightly and allowed to age at room temperature for 16 hours. An aluminum monohydroxide composition was prepared by heating 162 grams deionized water to 85° C., adding 16 grams of aluminum secondary butoxide while stirring, and adding 4 cubic centimeters of 1 M $HNO_3$ (moles acid/moles aluminum equals 0.06). The composition was stirred for 15 minutes, covered and allowed to age at 85° C. for 16 hours. The aluminum monohydroxide composition was then added to the siloxane composition at room temperature with stirring.

A surrogate liquid waste composition was prepared by dissolving the following nitrates in b 10 cc deionized water.

3.1990 grams $Fe(NO_3)_3 \cdot 9H_2O$ 0.9330 grams $UO_2(NO_3)_2 \cdot 6H_2O$ 1.0684 grams $Sr(NO_3)_2$ 1.6346 grams $NaNO_3$ Within 2–3 minutes after the siloxane and aluminum monohydroxide compositions were mixed, the surrogate liquid waste was added in the order listed while stirring at room temperature.

Alternatively, up to about 2% by weight of a surrogate solid waste (apatite) was added to the room temperature siloxane-aluminum monohydroxide mixture while stirring. The mixture was stirred and heat was applied at about 125° to 150° C. until a gel formed and was subsequently dried.

Generally, the volume reduction was about 33% to reach the gelatinous state and approximately an additional 33 vol % shrinkage occurred in obtaining a dried material. The total volume reduction was less with the solid waste loading, being about 50% at a 10% waste level. Using a quartz tray, a fairly thin bed of material was heated to 500° C. in air. The heating rate was about 1° C. per minute to 150° C., followed by rapid heating of about 10° C. per minute to 225° C., then about 1° C. per minute to 500° or 850° C. The material was held at 500° C. for 16 hours. The result was a totally amorphous granular material having a grain size of about 1 to 10 mm.

A second surrogate solid waste was prepared and tested in the same manner as the apatite. The second surrogate waste form simulated the analyzed composition of an actual sample of nuclear waste and had the following composition.

| | |
|---|---|
| $Fe_2(SO_4)_3$ | 54.5 wt % |
| $Al_2(SO_4)_3$ | 4.9 wt % |
| $MnSO_4$ | 3.3 wt % |
| $UO_2(NO_3)_2$ | 15.3 wt % |
| $Na_2PO_4$ | 4.9 wt % |
| $Sr(NO_3)_2$ | 2.8 wt % |
| $CaSO_4$ | 3.8 wt % |
| $NiPO_4$ | 10.5 wt % |

The amounts of this waste added to the mixed gel derivatives and also the gel were 1.0, 5.0 and 10.0 wt % total metal with respect to the Si plus Al. The following table gives the results of leach tests on these samples.

| Conditions During Leach Tests | Species Tested in Emission Spectrographic Analysis (μg/ml) | | | | | | | | | Leach Rate (total g/cm²/day) |
|---|---|---|---|---|---|---|---|---|---|---|
| | Al | Si | Fe | U | Sr | Na | Ca | P | F | |
| Glass Containing Waste | | | | | | | | | | |
| Test Water | <0.1 | 3.6 | <0.1 | <0.1 | <0.1 | <0.1 | | | | |
| [1]Static, R.T. $H_2O$, 2 wk | <0.5 | 9.5 | <0.5 | <0.5 | <0.1 | 1.6 | | | | $3.98 \times 10^{-11}$ |
| [2]Static, R.T. $H_2O$, 8 wk | 1.1 | 168 | 0.43 | 2.0 | 0.23 | 83 | | | | $2.71 \times 10^{-10}$ |
| [3]Soxhlet, 100° C. $H_2O$, 8 wk | 2.8 | 947 | 1.8 | 7.3 | 0.39 | 84 | | | | $1.05 \times 10^{-10}$ |
| Glass Containing 1% Apatite | | | | | | | | | | |
| Test Water | | | | | | | | | | |
| [4]Soxhlet, 100° C. $H_2O$, 6 wk | 0.46 | 38 | | | | 0.86 | 1.4 | 0.79 | 0.30 | $1.67 \times 10^{-10}$ |

Other details concerning samples:
[1]3780 ml $H_2O$, 14.50g of sample, 421 $m^2/g$ surface area of sample.
[2]3700 ml $H_2O$, 14.50g of sample, 421 $m^2/g$ surface area of sample.
[3]450 ml $H_2O$, 18.95g of sample, 421 $m^2/g$ surface area of sample.
[4]450 ml $H_2O$, 35.23g of sample, 6.95 $m^2/g$ surface area of sample.
Water pH at the conclusion of the experiments was 6.2–6.3 in all cases.

We claim:

1. A method of immobilizing nuclear waste comprising:

(A) preparing a composition which comprises:

(1) about 60% to about 100% by weight, calculated as $SiO_2$, of a hydrolyzed silicon compound having the general formula $SiR_m(OR')_nX_p$ or $Si(OSiR)_4$ where each R is independently selected from alkyl to $C_{10}$ and alkenyl to $C_{10}$, each R' is independently selected from R and aryl, each X is independently selected from chlorine and bromine, m is 0 to 3, n is 0 to 4, p is 0 to 1, and m+n+p equals 4;

(2) up to about 40% by weight, calculated as $Al_2O_3$, of an aluminum compound having the general formula $AlR_q'(OR)_rX_s$ or $Mg(Al(OR)_4)_2$, where each R is independently selected from alkyl to $C_{10}$ and alkenyl to $C_{10}$, each R' is independently selected from R or aryl, q is 0 to 3, r is 0 to 3, s is 0 to 1, and q+r+s equals 3;

(B) mixing 1 to about 50%, based on total weight, of said nuclear waste in liquid form into said composition;

(C) mixing up to about 10%, based on total weight, of said nuclear waste in solid form into said composition; and (D) heating said composition containing said nuclear waste at about 200° to about 500° C. to drive off water and organics.

2. A method according to claim 1 including the additional last step of sintering said composition at about 800° to about 900° C.

3. A method according to claim 1 including the last step of warm pressing said composition at about 350° to about 600° C. at about 30,000 to about 150,000 psi.

4. A method according to claim 1 wherein said nuclear waste is about 5% to saturated with dissolved solids and comprises about up to about 15% nitrate, up to 85% water, and up to about 10% undissolved solids.

5. A method according to claim 1 wherein said silicon compound has the general formula $SiR_m(OR')_nX_p$ where R' is alkyl to $C_4$ and n=4 and said aluminum compound has the general formula $AlR_q'(OR)_rX_s$ where R is alkyl to $C_4$ and r is 3.

6. A method according to claim 1 wherein said silicon compound is tetraethylorthosilicate and said aluminum compound is aluminum secondary butoxide.

7. A method according to claim 1 wherein said silicon compound is hydrolyzed in alcohol at a molar ratio of silicon compound to alcohol of about 0.2 to about 2, with water at a molar ratio of silicon compound to water of about 0.1 to about 5.

8. A method according to claim 1 wherein said composition comprises about 70 to about 90% of said silicon compound and about 10 to about 30% of said aluminum compound.

9. A glass immobilized nuclear waste made according to the method of claim 1.

* * * * *